United States Patent [19]

Kroth et al.

[11] 3,977,301

[45] Aug. 31, 1976

[54] LOW-EFFORT PROPORTIONAL CONTROL VALVE

[75] Inventors: Neil W. Kroth; Kenneth R. Lohbauer; James E. Scheidt, all of Joliet, Ill.

[73] Assignee: Caterpillar Tractor Co., Peoria, Ill.

[22] Filed: Jan. 31, 1975

[21] Appl. No.: 546,013

Related U.S. Application Data

[62] Division of Ser. No. 463,561, April 24, 1974, Pat. No. 3,903,787, which is a division of Ser. No. 211,333, Dec. 23, 1971, Pat. No. 3,847,180.

[52] U.S. Cl. ..... 91/412; 91/414; 137/596.13; 137/596.14

[51] Int. Cl.[2] ..... F15B 13/06

[58] Field of Search ..... 91/412, 414; 137/117, 137/596.12, 596.13, 596.14, 596.15, 596.16

[56] References Cited

UNITED STATES PATENTS

| | | | |
|---|---|---|---|
| 2,941,547 | 6/1960 | Rood | 137/596.13 |
| 3,150,685 | 9/1964 | Lohbauer et al. | 137/596.13 |
| 3,416,561 | 12/1968 | Kokaly | 137/596.13 X |
| 3,592,216 | 7/1971 | McMillen | 91/414 UX |
| 3,605,806 | 9/1971 | Coatti | 137/596.13 |

*Primary Examiner*—Alan Cohan
*Assistant Examiner*—Gerald A. Michalsky
*Attorney, Agent, or Firm*—Phillips, Moore, Weissenberger Lempio & Strabala

[57] ABSTRACT

A fluid control circuit for regulating fluid flow between a pressurized fluid source and a hydraulic motor, including a control valve having a movable spool for communicating fluid entering an inlet chamber from the source with service chambers in communication with the motor, a dump valve limiting communication of the inlet chamber with a drain in response to spring means and fluid communicated to the dump valve through a passage open to either of the service chambers when it is placed in communication with the inlet chamber by the control valve spool, the passage otherwise communicating the dump valve with a drain so that fluid communication between the inlet chamber and drain is limited only by the spring means. The force of the spring means may also be varied in certain embodiments of the invention. During operation of a second hydraulic motor by an additional control valve in communication with the inlet chamber, the dump valve is conditioned to provide pressure modulation in the inlet chamber by means of a bypass valve responsive to the additional control valve.

11 Claims, 5 Drawing Figures

11
34
36
37
38
39
41
42
94
96
97
77
98
88
86
24
A
53
32
31
99
76
74
68
66
64
69
71
87
84
83
89
81
72
67
27
26
33
91
82
73
93
92
43
28
12
62
58
63
59
61
47
52
51
46
22
44
54
23
56
24
48
49
14
13
18
19
16
21
17

LOW-EFFORT PROPORTIONAL CONTROL VALVE

This is a division, of Ser. No. 463,561, filed Apr. 24, 1974, now U.S. Pat. No. 3,903,787, issued Sept. 9, 1975 which was a division of Ser. No. 211,333 filed Dec. 23, 1971, now U.S. Pat. No. 3,847,180 issued Nov. 12, 1974.

BACKGROUND OF THE INVENTION

The present invention relates to a control circuit for regulating fluid communication between a pump or source and a hydraulic motor. More particularly, the invention relates to such a circuit adapted for regulating high pressure fluid flow as is commonly required in the operation of various machines such as earth-moving equipment.

In circuits of this type, load pistons subject to variable loading are commonly employed to modulate fluid pressure in an inlet chamber of a control valve during operation of the motor. With the control valve being of the closed-center or other types tending to block the inlet chamber when the motor is not being operated, pressurized fluid entering the inlet chamber from a source must constantly be vented or returned to a reservoir providing a fluid supply for the source. The load piston may be employed for this function.

However, in the prior art circuits, the load piston remains subject to substantial loading even when the motor is not operating. Accordingly, the pressure in the inlet chamber is relatively high even when the control valve is in neutral and the motor is not operating, causing substantial heat generation and power consumption when the fluid is vented from the inlet chamber to drain against the substantial force acting on the load piston.

Further, the substantial pressures remaining in the inlet chamber create flow forces acting on movable portions of the control valve. In high pressure circuits, the resulting flow forces may tend to hydraulically lock the control valve spool.

These problems are most severe in circuits employing high fluid pressures, for example, operating pressures in the order of 3,500 psi. Under such conditions, the flow forces acting upon the control valve spool are commonly so great that the spool cannot readily be manually operated but must rather be operated by pilot fluid pressure sufficient to counter the flow force effect on the spool. Even with pilot-operated control valves, the substantial pilot pressures required for operation of the spool make it difficult to provide accurate modulated control over fluid pressure in the inlet chamber. The lack of accurate pressure modulation may tend to cause erratic operation of the hydraulic motor which would be particularly noticable, for example, where accurate positioning of a load is to be accomplished by the motor.

Accordingly, it is one object of the present invention to provide a control circuit for minimizing or eliminating one or more of the problems referred to above.

It is also an object of the present invention to provide a control circuit for two hydraulic motors, each having a control valve, wherein a bypass valve conditions one of the control valves to provide pressure modulation during operation of the other control valve.

SUMMARY OF THE INVENTION

A control circuit embodying certain features of the present invention basically comprises a control valve for communicating fluid under pressure to a hydraulic motor with fluid pressure in an inlet chamber for the valve being modulated by a dump valve responsive both to spring means and actuating fluid pressure, the actuating fluid pressure being substantially completely relieved from interaction with the dump valve and communicated to a drain when the control valve is in a neutral condition so that pressure in the inlet chamber is then modulated by substantially the spring means alone.

An additional feature of the invention contemplates a control circuit having a valve for operating a first motor and including a means for modulating fluid pressure in an inlet chamber of the valve during operation of the first motor, a second valve for operating a second motor being in communication with the inlet chamber and a bypass valve means being effectively responsive to the second valve for conditioning the means in the first valve to modulate fluid pressure in the inlet chamber during operation of the second motor by the second valve.

Additional objects and advantages of the present invention are made apparent in the following description having reference to the accompanying drawings.

DESCRIPTION OF THE PREFERRED EMBODIMENT

Figure 1:
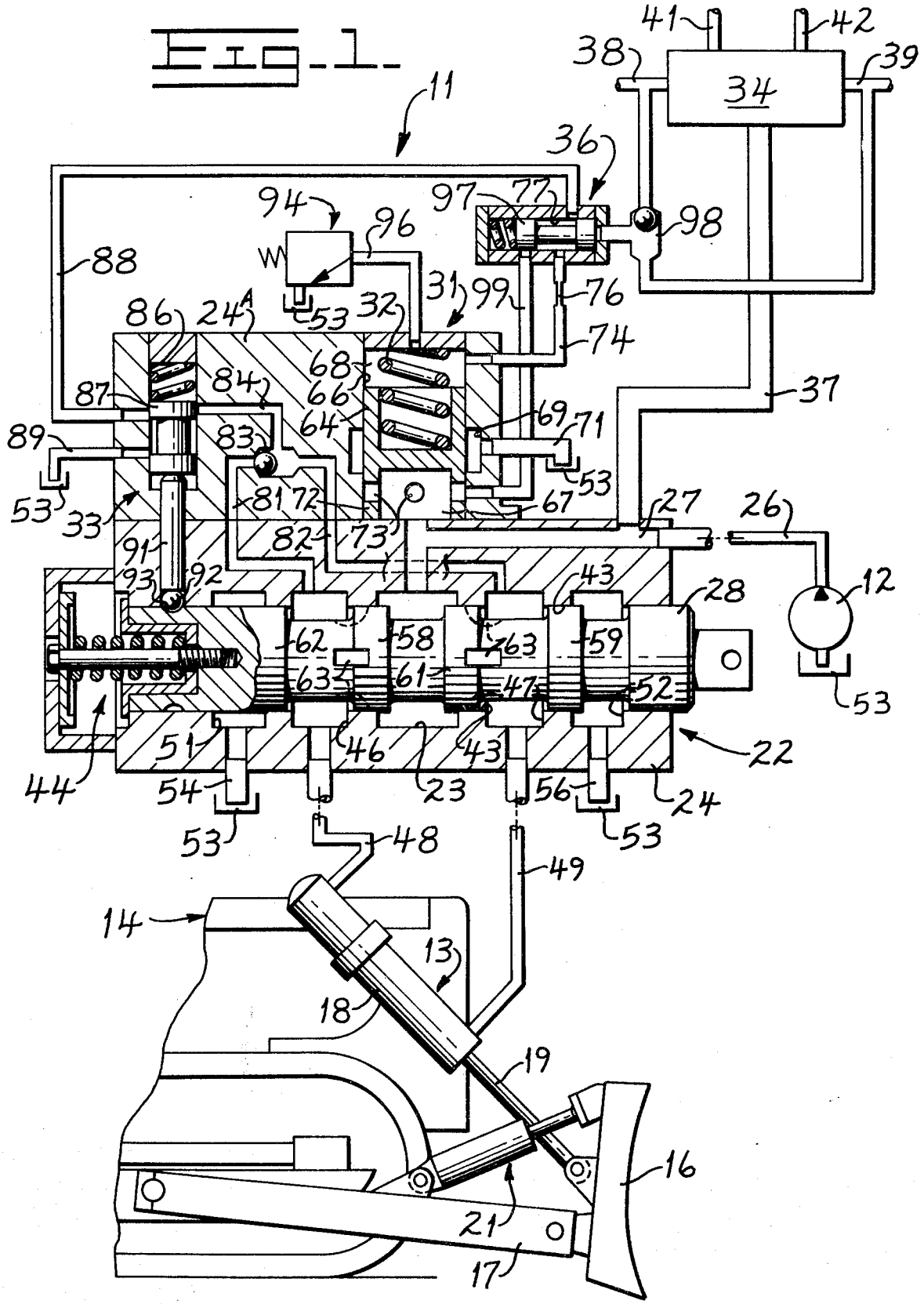
FIG. 1 is a representation, with parts in section, of a control circuit constructed according to the present invention for regulating fluid communication to a hydraulic motor which is preferably illustrated as a portion of an earthmoving machine.

A control circuit constructed according to the present invention is indicated at 11 in FIG. 1 for regulating fluid flow from a pump or source 12 to a hydraulic motor indicated at 13.

The motor 13 is preferably embodied as a double-acting jack for operating a component or implement of the earthmoving machine 14. As illustrated in FIG. 1, the earth-moving machine 14 is preferably a track-type tractor having a bulldozer blade 16 movably mounted at one end thereof by push arms, one of which is indicated at 17. The motor or jack 13 includes a cylinder 18 pivotably coupled to the tractor with an extendable rod 19 pivotably interconnected with the blade 16 so that operation of the jack 13 serves to raise and lower the blade 16 relative to the tractor 14. Additional motors or jacks, such as that indicated at 21 may be pivotably interconnected between the blade and the push arms 17, for example, as commonly employed for pitching and/or tilting of the blade 16 relative to the tractor 14.

Although the preferred embodiment of the invention, as illustrated in FIG. 1, is described for operating a double-acting motor or jack employed to adjust an implement or component of the vehicle 14, it will be apparent from the following description that the control circuit of the present invention may also be adapted for regulating operation of other hydraulic motors employed in a variety of applications.

Continuing with reference to the embodiment of FIG. 1, the control circuit 11 includes a control valve 22 having an inlet chamber 23 formed by the valve body 24 and in communication with the pump 12 by means of a conduit 26 and an internal passage 27 formed by the valve body 24. A spool 28 arranged in the valve 22 and operable by conventional means (not shown), selectively communicates fluid entering the inlet chamber 23 from the pump 12 with opposite ends of the jack 13 in a manner described in greater detail below.

A dump valve 31 is in commuication with the inlet chamber 23, the dump valve being responsive to spring means indicated at 32 and fluid pressure in a manner described below, for modulating fluid pressure in the inlet chamber 23 when the spool 28 is moved from the neutral position as illustrated in FIG. 1 for operation of the jack 13. When the spool 28 is in its neutral position as illustrated in FIG. 1, fluid pressure to which the dump valve 31 is responsive is communicated to drain so that fluid pressure in the inlet chamber 23 is then modulated by the dump valve 31 in response to the spring means 32 acting substantially alone. Regulating means 33 serves to establish fluid communication to which the dump valve is responsive according to the position of the spool 28 as is also described in greater detail below.

As noted above, the control circuit 11 is preferably adapted for use in applications requiring substantially high operating fluid pressure, for example, in the order of 3,500 psi, to operate a motor such as the jack indicated at 13. Due to the present combination of the control valve 22, the dump valve 31 and the regulating means 33, fluid pressure in the inlet chamber 23 may be modulated to a relatively minimum pressure, for example 50 psi, when the spool 28 is in its neutral or hold position. Accordingly, the pump 12 which operates against this minimum pressure, consumes minimum power and there is relatively little heat generation within the circuit 11 while fluid is being vented from the chamber 23. Further, the minimum pressure existing within the inlet chamber 23 also minimizes flow forces acting upon the spool 28 so that the spool may be manually operated or pilot operated by relatively low pilot fluid pressures to enhance fluid pressure modulation in the valve 22 when operation of the motor 13 is again commenced by repositioning of the spool 28.

Another feature of the present invention contemplates operation of an additional motor, such as the jack 21, by a second control valve 34 in the circuit 11. A bypass valve 36 is in responsive communication with the second control valve 34 and in communication with the dump valve 31 with operating fluid pressure being received by the second control valve 34 through a conduit 37 which is in effective communication with the inlet chamber 23. Accordingly, the dump valve 31 may be conditioned by the bypass valve 36 in response to operation of a second control valve 34 to modulate fluid pressure in the inlet chamber 23 and passage 27 which is communicated to the second control valve 34 through the conduit 37. The second control valve 34 is preferably pilot-operated by pilot fluid pressure received through respective conduits 38 and 39 with the second control valve being operable to selectively communicate fluid pressure to a motor such as the jack 21 through service conduits indicated at 41 and 42.

To describe the control valve 22 in greater detail, the spool 28 is slidably arranged in a bore 43 formed by the valve body 24 and further tending to be centered in the neutral position illustrated in FIG. 1 by spring means indicated at 44. Service chambers 46 and 47 are arranged along the bore 43 in axially spaced apart relation on opposite sides of the inlet chamber 23. The service chamber 46 is communicated by a conduit 48 with the head end of the cylinder 18 while the service chamber 47 is communicated with the rod end of the cylinder 18 by a conduit 49. Additional chambers 51 and 52 are formed along the bore 43 adjacent the service chambers 46 and 47 respectively, both of the chambers 51 and 52 being in communication with drain, as represented by the reservoirs commonly indicated for the circuit at 53 through the respective conduits 54 and 56.

The spool 28 is formed with a plurality of spaced apart lands for selectively communicating the service chambers 46 and 47 with the inlet chamber 23 and the drain chambers 51 and 52. The spool 28 is further constructed so that in its neutral position illustrated in FIG. 1, the service chambers 46 and 47 are blocked both from the inlet chamber 23 and the drain chambers 51 and 52. As the spool 28 is shifted for example to the right as viewed in FIG. 1 to cause extension of the jacks 13, a land 58 on the spool 28 is shifted into alignment with the inlet chamber 23 to communicate the inlet chamber 23 with the service chamber 46 so that fluid pressure from the pump 12 may pass to the head end of the cylinder 18. Another land 59 simultaneously communicates the other service chamber 47 with the drain chamber 52 to provide an outlet path for fluid being expelled from the rod end of the cylinder 18. When the spool 28 is shifted in the opposite direction, a land 61 similarly communicates the inlet chamber 23 with the service chamber 47 while a land 62 communicates the service chamber 46 with the drain chamber 51.

Metering slots 63 are formed in axially spaced apart relation upon the spool 28 to provide variable fluid communication between the inlet chamber 23 and the service chambers 46 and 47 as the spool 28 is initially shifted in either direction. When the spool 28 is shifted sufficiently so that one of the lands 58 or 61 passes out of register with the bore 43, substantially free communication is provided between the inlet chamber 23 and one of the service chambers 46 and 47.

The dump valve 31 includes spool or piston 64 slidably arranged in a bore 66 formed by a portion 24A of the valve body, the spool 64 dividing the bore 66 into a first end or chamber 67 and a second end or chamber 68. The first end 67 of the dump valve is in substantially open communication with the inlet chamber 23. An annular passage 69 is also formed along the bore 66 in communication with the drain or reservoir 53 through a conduit 71. The spool 64 has a tubular portion 72 forming radially arranged openings or ports 73 with the spool 64 being movable in the bore 66 for controlling communication between the radial ports 73 and the annular passage 69. The spring 32 tends to urge the spool 64 downwardly into the first end of the bore 66 so that the ports 73 are out of register with the passage 69 and fluid communication is blocked between the inlet chamber 23 and the drain provided through the conduit 71. However, fluid pressure entering the inlet chamber 23 and accordingly the first end 67 of the bore 66 tends to urge the spool 64 upwardly with the ports 73 entering into register with the passage 69 so that the inlet chamber 23 is in communication with the drain provided through the conduit 71.

As noted above, the dump valve 31 is also responsive to fluid pressure communicated to its second end or chamber 68 entering through a conduit 74. The conduit 74 includes a restrictive orifice 76 and is in communication with the bore 77 of the bypass valve 36.

The regulating means 33 includes various components for selectively communicating the service chambers 46 and 47 with the conduit 74 across the bypass valve 36. Branched passages 81 and 82 respectively communicate the service chambers 46 and 47 with a shuttle valve 83 having a common passage 84 also in communication with another bore 86 in which a spring loaded spool 87 is slidably arranged. One conduit 88 communicates the bore 86 with the bypass valve 36 while another conduit 89 communicates the bore 86 with the drain or reservoir 53.

A piston 91 slidably penetrates the bore 86 for interaction with the spring loaded spool 87. The lower end of the piston 91 is abutted by a ball 92 which rides in an annular groove 93 of the control valve spool 28 when it is in its neutral position as illustrated in FIG. 1. With the control valve spool 28 in its neutral position, the spring loaded spool 87 is accordingly positioned to communicate the conduit 88 with the conduit 89 so that the second chamber or end 68 of the dump valve bore 66 is in communication with the drain 53. When the control valve spool 28 is shifted in either direction, the ball 92 rides out of the groove 93 and causes the piston 91 to shift the spring loaded spool 87 upwardly to block the conduit 88 from communication with the drain conduit 89 and place it in communication with the common conduit 84. The shuttle valve 83 serves to communicate fluid pressure from either of the service chambers 46 and 47 to the common conduit 84 and then to the second end 68 of the dump valve through the conduit 88, the bypass valve 36 and the conduit 74.

When the control valve spool 28 is shifted in either direction, fluid pressure entering the second chamber 68 of the dump valve combines with the spring 32 to urge the dump valve spool 64 downwardly to limit communication between the inlet chamber 23 and drain conduit 71, thus providing for pressure modulation of fluid in the inlet chamber 23. While the inlet chamber 23 is in communication with one of the service chambers only by the metering slots 63, the pressure differential therebetween is accordingly a function of the selected strength of spring 32. When the spool is moved sufficiently in either direction to provide open communication between the inlet chamber 23 and one of the service chambers, the differential pressure ceases and fluid pressure in the second chamber 68 of the dump valve is substantially equal to that in the inlet chamber 23. Under this condition, a pilot relief valve 94 in communication with the chamber 68 by a conduit 96 selectively communicates the chamber 68 with the drain 53 to protect the circuit from overpressures developed therein. Thus, fluid flow between the inlet chamber 23 and one of the service chambers is a function of the control valve spool 28 position while being independent of working pressures in the service chambers.

The by-pass valve 36 includes a spring-loaded spool 97 arranged in its bore 77 and a shuttle valve 98 for communicating pilot fluid pressure from either of the conduits 38 and 39 against the spring-loaded spool 97. The by-pass valve bore 77 is also in communication with the first chamber 67 of the dump valve 31 by means of a conduit 99. During operation of the second control valve 34, pilot fluid pressure in either of the conduits 38 and 39 shifts the by-pass spool 97 to place the conduits 99 and 74 in communication so that the opposite ends or chambers 67 and 68 of the dump valve 31 are in communication with fluid pressure being equalized on opposite sides of the dump valve spool 64. Thus, during operation of the second control valve 34, the dump valve 31 tends to function as a conventional pilot operated relief valve for modulating fluid pressure in the inlet chamber 23, the passage 27 and the conduit 37 in communication with the second control valve.

Figure 2:
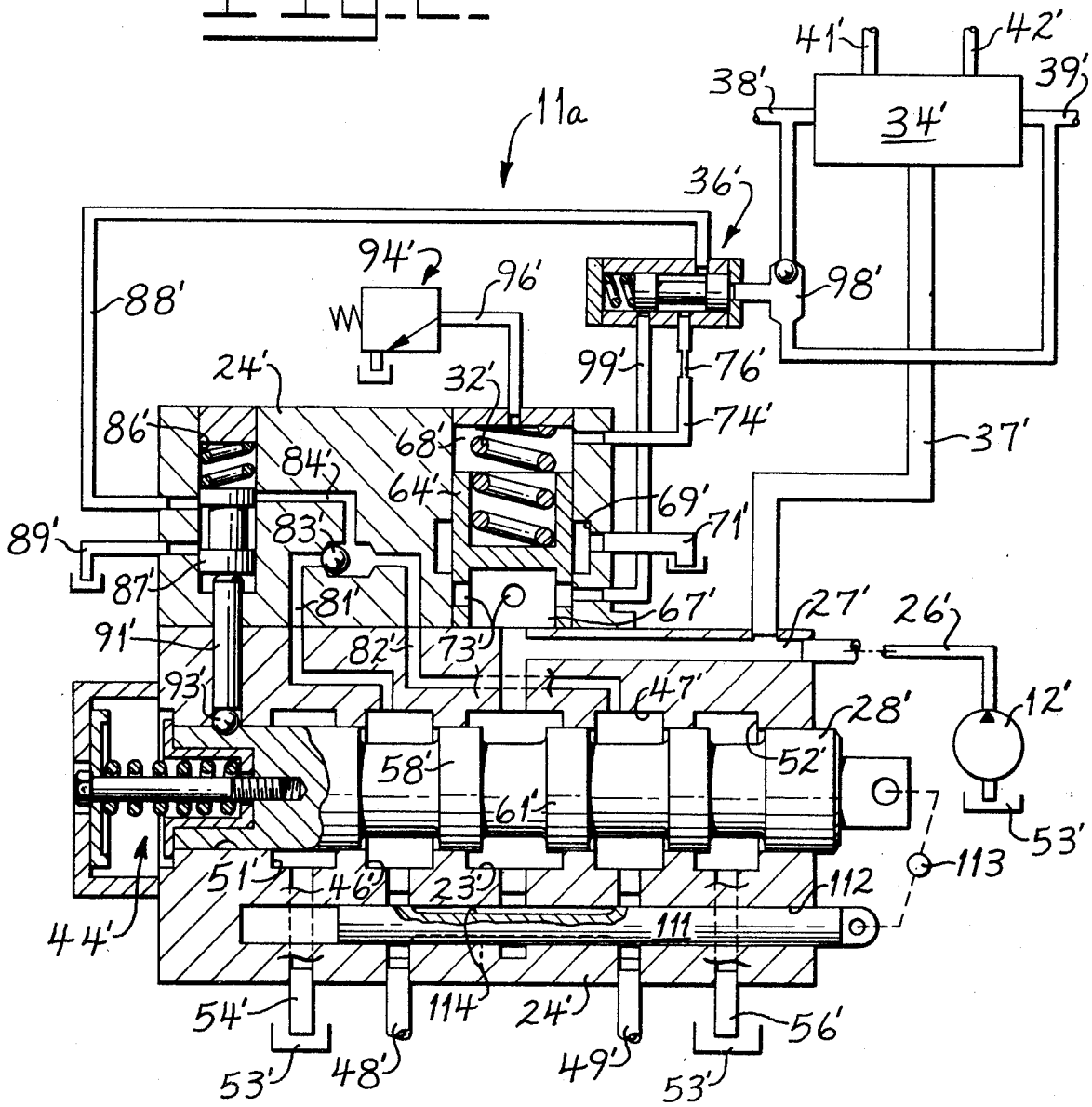
FIG. 2 is a representation similar to FIG. 1, of another embodiment of a control circuit constructed according to the present invention.

The embodiment of FIG. 2 is generally similar to that of FIG. 1, most of its components being identified by primed numerals corresponding to FIG. 1. However, the control valve spool 28' does not have metering slots such as those shown in FIG. 1 at 63. Metering action for the spool 28' is accomplished instead by means of an auxiliary spool 111 slidably arranged in a bore 112 formed by the valve body 24'. The auxiliary spool 111 is coupled for movement with the control valve spool 28' by means generally indicated at 113 and has one or more elongated slots 114 for selectively communicating the inlet chamber 23' with either of these service chambers 46' and 47' in the same manner as accomplished by the metering slots indicated at 63 in FIG. 1. Use of the auxiliary spool 111 for forming the metering slots 114 simplifies construction of the main control spool 28' while providing simply formed means for accurately metering fluid pressure between the inlet chamber 23' and the service chamber 46' and 47'.

Figure 3:
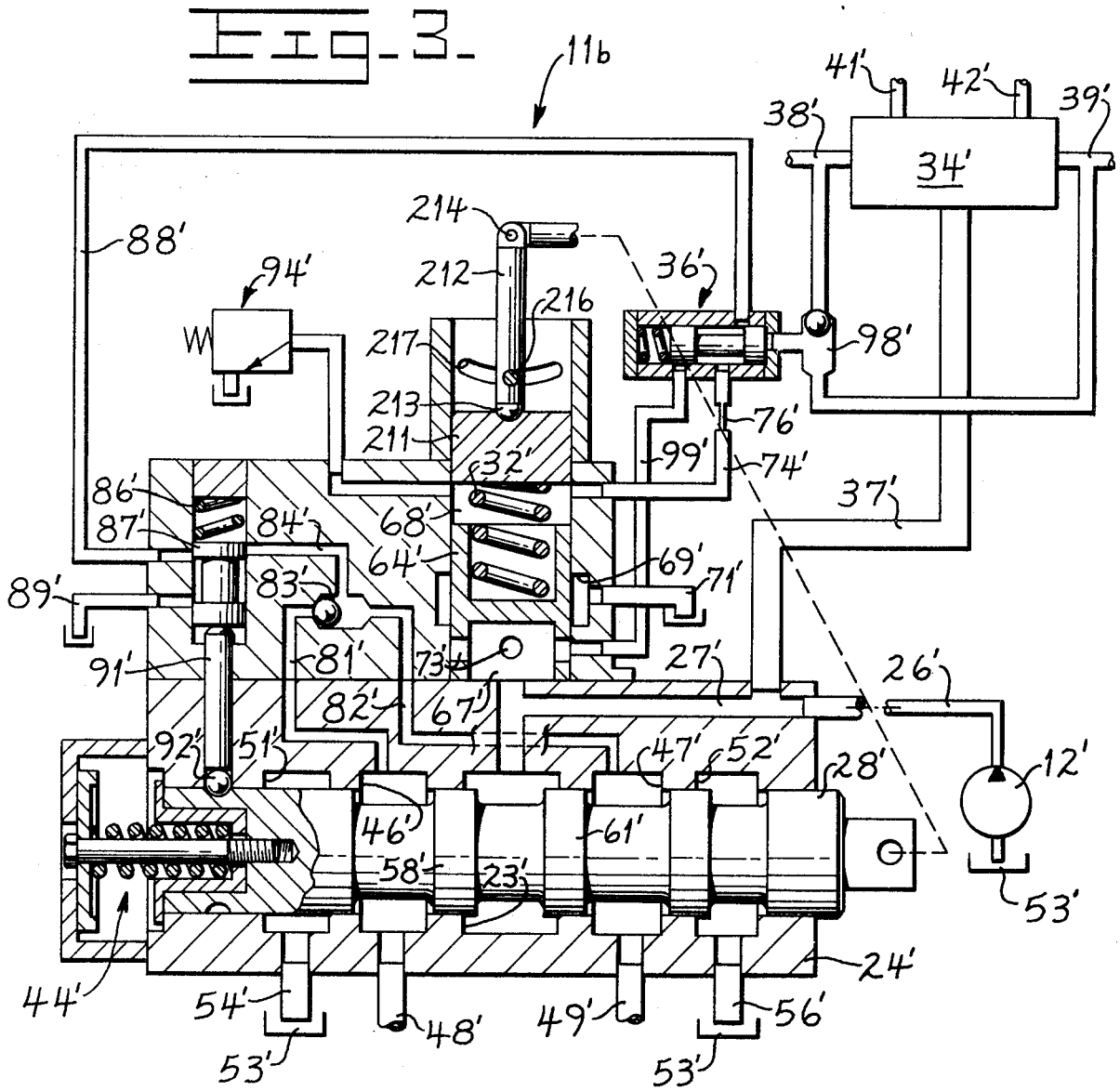
FIG. 3 is a representation also similar to FIG. 1 of still another embodiment of a control circuit constructed according to the present invention.

The embodiment of FIG. 3 includes another control circuit 116 which is again substantially similar in construction and operation to the circuit 11 of FIG. 1 with primed numerals being employed to indicate corresponding components of the circuit. Again, note that the control valve spool 28' is formed without the metering slots indicated at 63 in FIG. 1. However, variable pressure modulation in the inlet chamber 23' is similarly accomplished by varying the effective force of the spring 32' upon the dump valve spool 64' by means of a movable reaction piston 211 which is slidably arranged in the dump valve bore 66' to provide a seat for the spring 32'. A lever 212 has one end pivotably coupled to the reaction piston 211 as indicated at 213 with its other end 214 being coupled for movement with the control valve spool 28'. A pin 216 secured to the lever 212 adjacent the coupling 213 rides in an arcuate slot 217 formed in an external end of the dump valve bore 66'. Accordingly, with the control valve spool 28' in its neutral position as illustrated, the reaction piston 211 is shifted downwardly so that the spring 32' applies maximum force against the spool 64'. As the control valve spool 28' is moved in either direction from its neutral position, the reaction piston 211 is shifted upwardly so that the force with which the spring 32' acts upon the spool 64' is gradually relaxed until the control valve spool 28' provides substantially free communication between the inlet chamber 23' and one of the service chambers 46' and 47'. Accordingly, as the effective load of the spring 32' is decreased, modulation of fluid pressure in the inlet chamber 23 and one of the service chambers 46 and 47 is relatively decreased to accomplish the same purpose as described above for the metering slots indicated at 63 in the embodiment of FIG. 1. Otherwise, the various components of the control circuit 11*b* of FIG. 3 function in substantially the same manner as described above for the circuit 11 of FIG. 1.

Figure 4:
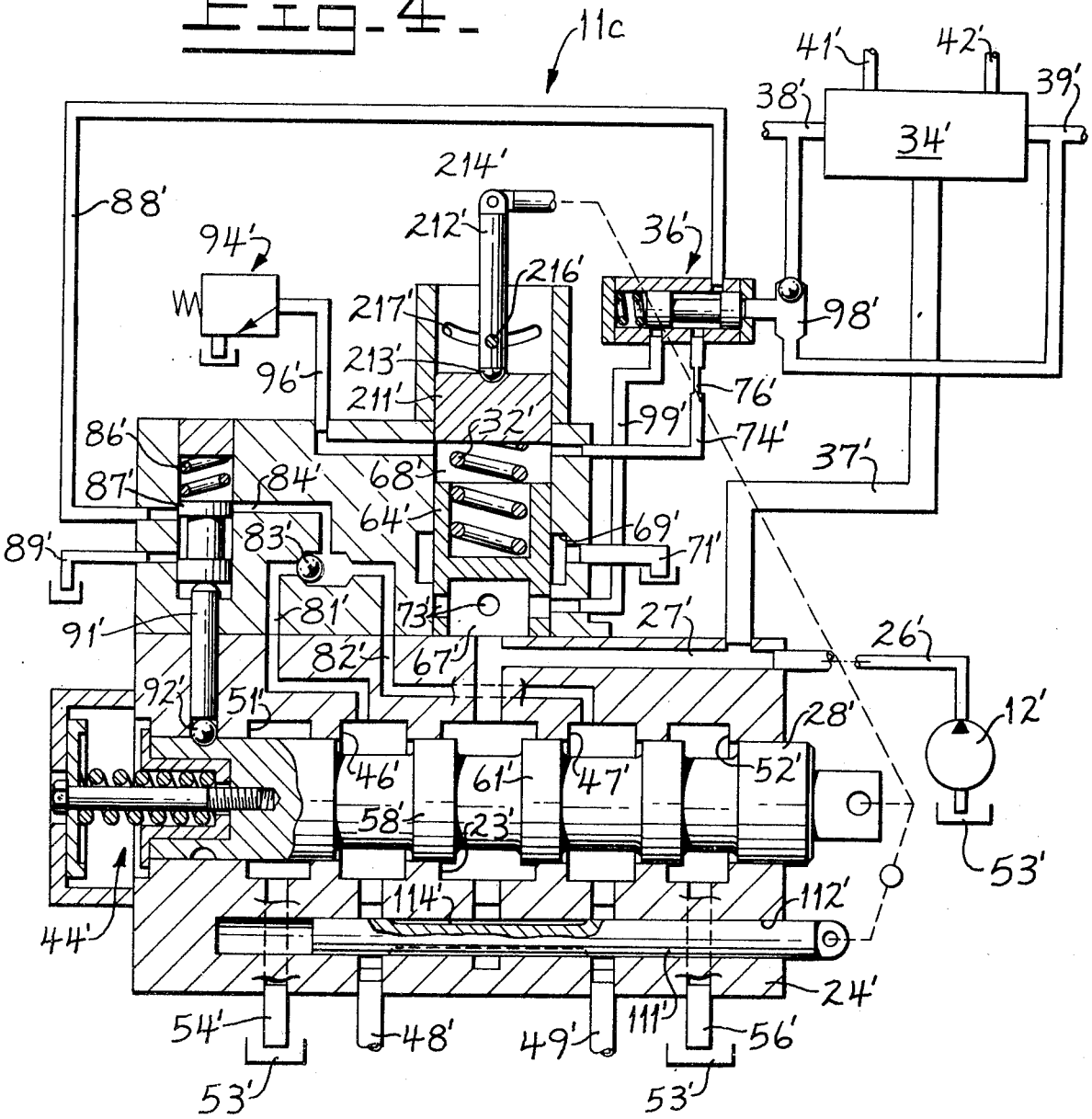
FIG. 4 is also a similar representation of yet another embodiment of the invention including certain features common respectively to the embodiment of FIGS. 2 and 3.

The embodiment of FIG. 4 includes both the auxiliary spool 111 as in FIG. 2 for forming metering slots 114 together with the movable reaction piston 211 as described above with reference to FIG. 3 for varying the effective force of interaction between the spring 32' and the dump valve spool 64', primed numerals being again employed to indicate corresponding components of the circuits. The combination of these features enables the control circuit 11*c* of FIG. 4 to operate in substantially the same manner as the embodiments 11, 11*a* and 11*b* described above. Further, within this arrangement, the metering slots 114' on the auxiliary spool 111' could be made much smaller and movement of the reaction piston 211' could be more closely controlled since these components are operating in combination to establish a differential pressure between the inlet chamber 23' and one of the service chambers 46' and 47'.

Figure 5:
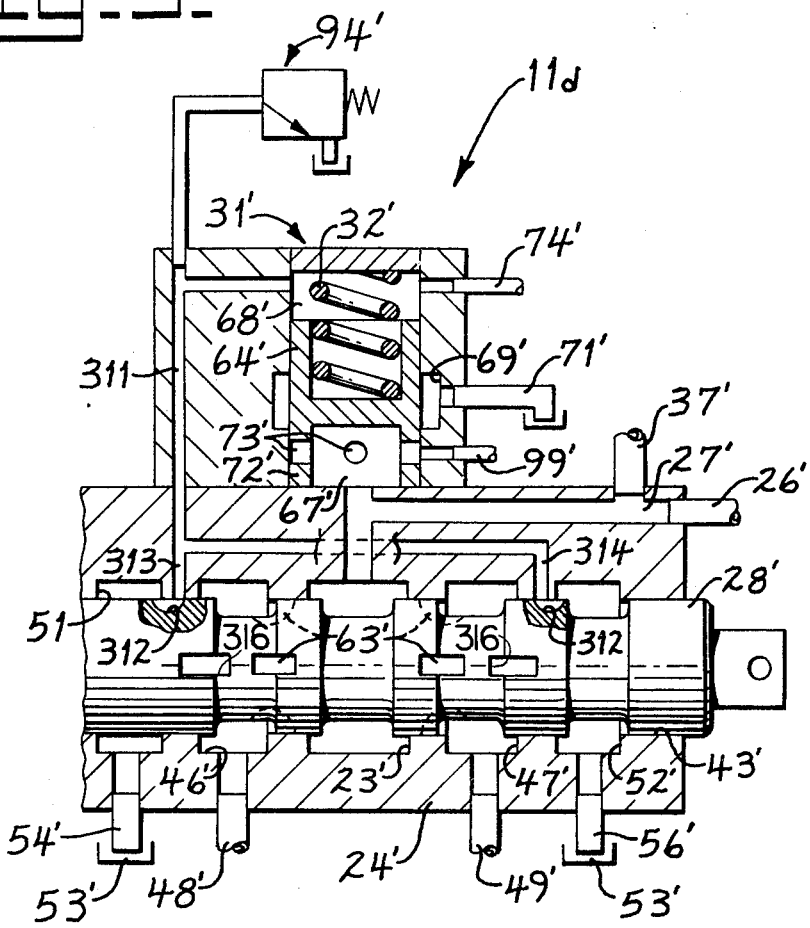
FIG. 5 is a fragmentary representation of a further embodiment of the invention.

The embodiment of FIG. 5 illustrates yet another version of a control circuit 11*d* which is substantially similar to the circuit 11 of FIG. 1 with corresponding parts accordingly being indicated by primed numerals. However, the circuit 11*d* of FIG. 5. includes a variation of the regulating means indicated at 33 in FIG. 1 for selectively establishing fluid communication with the second chamber 68' of the dump valve 31'.

As illustrated in FIG. 5, a branched internal passage 311 formed in the valve body 24' communicates the second chamber 68' of the dump valve 31' with the control valve bore 43'; at two points intermediate the service chambers 46', 47' and the respective drain chambers 51' and 52'. Axially aligned slots 312 are formed upon the spool 28' generally for alignment with the branched passages 313 and 314 respectively when the control valve spool 28' is in its neutral position as illustrated in FIG. 5. As the control valve spool 28' is shifted toward the right to communicate the inlet chamber 23' with the service chamber 46' one of the elongated slots 312 in communication with the branch passage 313 enters into communication with the service chamber 46' to communicate fluid pressure from the service chamber to the second chamber 68' of the dump valve 31' in generally the same manner as described above for the embodiment of FIG. 1. Simultaneously, the other elongated slot 312 passes out of communication with the passage branch 314. It may be seen that the slots function in much the same manner when the control valve spool 28' is shifted in the opposite direction to communicate the service chamber 47' with the second chamber 68' of the dump valve 31'. The second chamber 68' of the dump valve 31' is in communication with either or both of the drain chambers 51' and 52' when the spool 28' is in its neutral position to completely relieve fluid pressure combining with the spring 32' for interaction upon the dump valve spool 64'.

The slots 312 are axially formed in the spool 28' rather than being annular passages extending around the spool to avoid intercommunication with additional metering slots indicated at 316. Accordingly, the spool 28' is angularly positioned in the bore 43' to maintain desired communication between the slots 312 and the branched passages 313 and 314. It may be noted that the slots 316 are somewhat longer in an axial direction than the metering slots 63'. This allows the slots 316 to simultaneously provide variable communication of one of the service chambers 46' and 47' with the adjacent drain chambers 51' and 52' as the other service chamber is communicated with the inlet chamber 23' by the slots 63'. Additional metering slots similar to those indicated at 316 but not necessarily formed in the same manner, could also be employed in the other embodiments of this invention to further improve modulation control.

We claim:

1. A fluid control circuit for regulating operation of a double-acting hydraulic motor and including first hydraulic motor means, a source of fluid under pressure, a control valve body defining a bore, an inlet chamber being in communication with the bore and the source, service chambers being respectively in communication with the control valve bore in axially spaced apart relation on opposite sides of the inlet chamber, drain means also being in communication with the control valve bore and a spool reciprocably arranged in the control valve bore and having a neutral position wherein the spool blocks the inlet chamber from communication with both service chambers, the spool being movable in opposite directions from its neutral position for respectively communicating the inlet chambers with the service chambers and drain means and comprising:

a dump valve forming a bore having one end in free communication with the inlet chamber, a dump spool being movably arranged in the dump valve bore for separating its one end from its other end, the dump valve bore having an opening in communication with drain, the dump spool being movable toward the one end of the dump valve bore to block the inlet chamber from the drain opening and toward the other end of the dump valve bore to communicate the inlet chamber with the drain opening, spring means urging the dump spool toward the one end of the dump valve bore;

means forming passages for communicating the other end of the dump valve bore with the service chambers and with the drain;

regulating means being movable with the control valve spool and in regulating communication with the passages to communicate the other end of the dump valve bore with the respective service chambers when they are placed in communication with the inlet chamber by the control valve spool and to communicate the other end of the dump valve bore with the drain when the control valve spool is in its neutral position; and second hydraulic motor means having an inlet passage in communication with the inlet chamber of the control valve, a bypass valve in responsive communication with the second motor means and normally providing communication for the passages from the service chambers with the other end of the dump valve bore, the bypass valve functioning in response to operation of the second motor means for directly communicating the other end of the dump valve bore with its one end, the dump valve then functioning as a pilot operated relief valve during operation of the second motor means.

2. The control circuit of claim 1 wherein the bypass valve is in communication with the one end of the dump valve bore by means of an opening in the dump valve bore arranged intermediate the radial drain opening and the inlet chamber, the dump valve spool having a tubular portion forming a radial opening for regulating communication of the one end of the dump valve bore with the radial drain opening and the opening in communication with the bypass valve.

3. The control circuit of claim 2 wherein the control valve spool is movable in opposite directions from its neutral position to provide substantially free communication between the inlet chamber and the respective service chambers, metering means being movable with the control valve spool to provide a variable opening between the inlet chamber and the respective service chambers as the spool is moved from its neutral position toward its respective positions providing substantially free communication with the respective service chambers, the spring means being selected to establish a differential pressure between the inlet chamber and each of the respective service chambers when they are communicated by the metering means and to establish the only substantial force tending to urge the dump spool toward the one end of the dump valve bore and limit communication between the inlet chamber and drain opening when the control valve spool is in its neutral position.

4. A fluid control circuit for independently regulating operation of a first hydraulic motor and a second hydraulic motor, the circuit including a source of fluid under pressure, a first control valve having an inlet chamber in communication with the source, a service chamber in communication with the first motor and movable spool means for selectively communicating the inlet and service chambers, second control valve means in communication through the inlet chamber of the first control valve with the source and in operative communication with the second motor, comprising a dump valve in communication with drain means and having a first chamber, a second chamber and piston means arranged therebetween the piston means being responsive to fluid pressure in the first chamber for tending to communicate the first chamber with the drain, spring means arranged for interaction with the piston means, the piston means tending to block communication between the first chamber and the drain in response to interaction with the spring means and also in response to fluid pressure in the second chamber, regulating means operatively coupled with the spool means and in communication with the second chamber of the dump valve, the regulating means communicating the second chamber with the service passage when the spool means communicates the inlet and service chambers, and bypass valve means in responsive communication with the second control valve means and in communication with the first and second chambers of the dump valve, the bypass valve means functioning in response to operation of the second motor by the second control valve means for communicating the second chamber with the first chamber and conditioning the dump valve for operation as a pilot-operated relief valve.

5. The control circuit of claim 4 further comprising an overpressure relief valve in communication with the second chamber of the dump valve.

6. The control circuit of claim 4 wherein the bypass valve normally communicates the regulating means with the second chamber, a fluid passage between the bypass valve means and the second chamber including a restrictive orifice means.

7. The control circuit of claim 6 further comprising an overpressure relief valve in communication with the second chamber of the dump valve.

8. The control circuit of claim 4 wherein the second control valve means is a pilot-operated valve having a pilot fluid inlet passage which is also in communication with the bypass valve.

9. The control circuit of claim 4 wherein the spool means is movable from a neutral position for blocking the inlet chamber into an operating position for providing substantially free communication between the inlet chamber and the service chamber, metering means being movable with the spool means to provide a variable opening between the inlet chamber and service chamber as the spool means is moved from its neutral position toward its operating position, the spring means being selected to establish a differential pressure between the inlet chamber and the service chamber when they are communicated by the metering means and to establish the only substantial force urging the piston means toward the first chamber for limiting communication between the inlet chamber and drain passage when the spool means is in its neutral position.

10. The control circuit of claim 9 further comprising an overpressure relief valve in communication with the second chamber of the dump valve.

11. The control circuit of claim 10 wherein the bypass valve normally communicates the regulating means with the second chamber, a fluid passage between the bypass valve means and the second chamber including a restrictive orifice means.

* * * * *